United States Patent [19]

Sooter et al.

[11] 4,140,623

[45] Feb. 20, 1979

[54] INHIBITION OF COKE PUFFING

[75] Inventors: Matthew C. Sooter, Ponca City, Okla.; Lynn J. Whitebay, Carlinville, Ill.

[73] Assignee: Continental Oil Company, Ponca City, Okla.

[21] Appl. No.: 836,331

[22] Filed: Sep. 26, 1977

[51] Int. Cl.[2] ..... C10G 9/14

[52] U.S. Cl. ..... 208/131; 201/20; 208/125

[58] Field of Search ..... 208/46, 106, 131, 125; 201/20, 23

[56] References Cited

U.S. PATENT DOCUMENTS

| | | | |
|---|---|---|---|
| 3,704,224 | 11/1972 | Scovill et al. | 208/106 |
| 3,759,822 | 9/1973 | Folkins | 208/131 |
| 3,769,200 | 10/1973 | Folkins | 208/131 |
| 3,873,427 | 3/1975 | Long et al. | 201/20 |
| 3,930,985 | 1/1976 | Schieber et al. | 208/46 |

*Primary Examiner*—Herbert Levine

*Attorney, Agent, or Firm*—Richard W. Collins

[57] ABSTRACT

Puffing of electrode grade coke during graphitization is reduced or eliminated by addition of a puffing inhibitor to the coker feedstock prior to formation of the coke.

3 Claims, No Drawings

INHIBITION OF COKE PUFFING

BACKGROUND OF THE INVENTION

1. Field of the Invention

This invention relates to the manufacture of graphite electrodes from petroleum coke, and more particularly to the inhibition of "puffing" of coke during graphitization of premium coke electrodes. These electrodes, primarily used in the electric furnace steel making process, must meet rigid specifications. Much of the petroleum coke presently available commercially has a tendency to expand rapidly and irreversibly during the heat treatment required as part of the electrode manufacturing process. This expansion is commonly referred to as "puffing". When the puffing phenomenon occurs to too great an extent, the electrode is rendered useless.

2. Prior Art

The reduction or elimination of the puffing phenomenon has been acomplished in the past by adding a puffing inhibitor to a blend of calcined petroleum coke and binder pitch prior to extruding and baking the electrode.

A method of controlling puffing comprising adding sodium carbonate prior to extruding the electrode is described in U.S. Pat. No. 2,814,076.

A method of controlling puffing by addition of iron oxide prior to extruding and baking an electrode is described in U.S. Pat. Nos. 3,506,745 and 3,624,231.

A method of blending petroleum coke with an oxygen-containing compound of iron, calcium, aluminum or manganese to inhibit puffing during graphitization is described in U.S. Pat. No. 3,842,165.

The addition of a titanium or zirconium compound with conventional puffing inhibitors is described in U.S. Pat. No. 3,563,705; and the addition of calcium cyanamid as a puffing inhibitor is disclosed in U.S. Pat. No. 3,642,962.

A method of producing a low sulfur coke comprising addition of an iron compound and a metal chloride, either to a coker feedstock or subsequent to the coking operation, is described in U.S. Pat. No. 3,873,427. The process described in that patent contemplates addition of a large amount, such as from 3 to 25 weight percent, of an iron compound along with a metal chloride, and the resulting low sulfur coke is not suitable for electrode manufacture because of the high level of impurities introduced during the desulfurization step.

Conventional commercial graphite electrode manufacture presently utilizes the addition of from 0.5 to 3.0 percent iron oxide mixed with coke and binder pitch prior to extrusion and baking of the electrode. This procedure has been quite effective in controlling puffing of the electrode during the graphitization step.

It is an object of the present invention to provide an improved process for reducing or eliminating puffing during manufacture of graphite electrodes.

It is a further object of the invention to provide such a process which results in an electrode having a lower level of impurities than results from conventional methods of manufacture.

SUMMARY OF THE INVENTION

In accordance with the present invention, electrode puffing is controlled by addition of a small amount of a puffing inhibitor to a coker feedstock prior to introducing the feedstock to a coking drum. The addition of from 0.005 to 1.0 percent by weight, based on weight of coker feedstock, of an inhibitor such as iron oxide to a coker feedstock has been found to inhibit puffing as effectively as does the addition of a much larger amount of puffing inhibitor to a blend of calcined coke and binder pitch in accordance with conventional procedure.

DESCRIPTION OF THE PREFERRED EMBODIMENTS

As used herein, the term "premium coke" is used to describe delayed petroleum coke which is suitable for manufacture of large graphite electric arc steel furnace electrodes.

In order for coke to be marketable as premium coke, it must meet certain specifications as to composition and physical properties. An important specification is the linear coefficient of thermal expansion (CTE). One method of determining the CTE of a coke is the optical lever method in which the expansion of a bar formed of graphitized coke is measured over a temperature range of 30° to 98° C. The CTE measured in this manner should be less than $7.0 \times 10^{-7}/°$ C., and in many cases must be less than $5.0 \times 10^{-7}/°$ C. in order to meet customer requirements. The CTE of an actual large electrode made from such coke is normally slightly higher than that of the graphite test rod.

The conventional process for making premium coke comprises introducing a premium coker feedstock or feedstocks such as thermal tar, decant oil from a fluid catalytic cracking unit, pyrolysis tar or the like to a coker furnace where the feedstock is heated to coking temperature, generally from 425° to 540° C., followed by introduction of the heated feedstock to a delayed coking drum maintained at typical premium coking conditions of from 440° to 470° C. and 2.5 to 7 kg/cm$^2$. The coke product is removed from the coking drum, and is typically calcined in a rotary kiln at a temperature of from 1100° to 1500° C. to remove volatile material therefrom. The calcined coke is then sized to a desired size distribution such as from 200 mesh material to about 3 or 4 mesh material, blended with a binder pitch and extruded into the desired electrode configuration. The thus-formed material is then baked at a temperature of from 800° to 1200° C. to carbonize the binder pitch and to give the extruded electrode strength. Finally, the baked electrode is graphitized by heating to a temperature of from 2500° to 3000° C. to produce the graphitized electrode. The graphitized electrode is then machined to specifications for use in an electric arc steel furnace.

According to present commercial practice, premium coke having an amount of sulfur insufficient to cause puffing can be graphitized as described above without addition of a puffing inhibitor. Premium coke having an amount of sulfur high enough to cause puffing generally is treated with from 0.5 to 3.0 weight percent iron oxide, depending on the amount of sulfur and the degree of puffing, added to a mixture of calcined coke and binder pitch prior to extrusion and baking. Premium coke having less than 0.25 weight percent sulfur normally does not require a puffing inhibitor. Premium coke having up to about 0.7 weight percent sulfur may require an inhibitor, and premium coke having more than that amount almost always needs an inhibitor.

According to the present invention, the above procedure is modified by adding the puffing inhibitor to the coker feedstock prior to introduction of the feedstock to the coking drum, and by utilizing a much lower amount of the inhibitor. The exact operation of the inhibitor is not clearly understood, but it is apparent that when the inhibitor is added directly to the coker feedstock prior to formation of the coke particles, the inhibitor is distributed throughout the coke particles more or less uniformly, whereas according to conventional techniques for adding the inhibitor, the inhibitor can only contact the outer surface of the previously formed coke particles.

The preferred inhibitors in accordance with the invention are oxygen-containing compounds of iron, calcium, aluminum and manganese. Of these, iron oxide is the preferred material. Inhibitors in solid particle form can be added to the coker feedstock by forming a slurry of the inhibitor particles with a portion of the feedstock and injecting it at the discharge of the furnace charge pump. Any conventional puffing inhibitor can be used in the invention, including oxygen-containing compounds of iron, calcium, aluminum and manganese, with or without a titanium or zirconium compound. The oxides, hydroxides and carbonates of these elements all have utility as puffing inhibitors. Ferric oxide is widely used because of its availability and low price. Finely divided iron powder may also be used.

In accordance with one embodiment of the invention, the puffing inhibitors are added in hydrocarbonsoluble form. Acetyl acetonates of metals are soluble in hydrocarbons and can be used as a source of the inhibiting metal. Another soluble iron compound which is suitable is ferrocene. The use of soluble compounds as a source of the inhibitor assures maximum uniformity of dispersion, and also eliminates the problems associated with presence of particulate material in the piping.

The invention is applicable in the formation of graphitized electrodes from coke containing an amount of sulfur sufficient to cause an undesirable amount of puffing. The amount of inhibitor needed is dependent to some extent upon the sulfur level in the feedstock, and varies from about 50 parts per million to about 1.0 percent by weight of the inhibiting metal in the coker feedstock. The level of inhibitor in the coke is dependent on the coke yield. For example, if a feedstock makes 30 weight percent coke, the metal inhibitor in the coke would be expected to be about three times as much as the level in the feedstock, as the inhibitor tends to concentrate in the coke rather than in the volatile material going from the coke drum as vapor.

The improved results obtained by operation in accordance with the invention are illustrated in the following example.

EXAMPLE I

In this example, various amounts of iron oxide were added to a blend of binder pitch and previously formed coke particles. The amount of expansion of the resulting material during heat treatment is shown in Table 1 below.

Table 1

| ppm Iron Added as Ferric Oxide | Degree of Puffing (Percent of Length) |
|---|---|
| 0 | 7.0 |
| 300 | 7.0 |
| 700 | 6.2 |
| 1100 | 5.9 |
| 2500 | 4.4 |

In another run where the conditions were the same as for the experiments listed in Table 1, a coker feedstock to which iron oxide had been added was coked, and the resulting coke with the iron distributed therethrough was blended with binder pitch and tested in the same manner as the samples to which the iron oxide had been added later. The resulting coke contained 1260 parts per million of iron and showed an expansion of only 2.4 percent, whereas, as can be seen from Table 1 above, addition of 2500 parts per million iron after the coke was formed produced an electrode which exhibited 4.4 percent expansion. Thus, it can be seen from the above example that operation in accordance with this invention provides reduced puffing compared to operation with a larger amount of inhibitor added after the coke has been formed.

To meet most specifications, it is generally required that the expansion during graphitization be of the order of 1.0 percent or less, and preferably an expansion of near zero is obtained. The required reduction or elimination of puffing can be obtained according to this invention utilizing a much lower amount of inhibitor than is required according to conventional practice.

The process according to this invention involves addition of from 50 parts per million to 1.0 percent by weight of a puffing inhibitor to a coker feedstock. Preferably, from 500 to 5000 parts per million of the puffing inhibitor, based on the amount of metal in the inhibitor compound, is added to the feedstock.

The point of addition of the inhibitor may be anywhere upstream from the coking drum, but preferably is at the discharge of the coker furnace charge pump to minimize materials handling problems, particularly when a particulate inhibitor is utilized.

It is essential in accordance with the invention that an effective amount of a puffing inhibitor be added to a coking feedstock prior to forming coke in the coke drum. When this is done, reduction or elimination of puffing is obtained with a smaller amount of inhibitor than is required according to conventional practice. The foregoing detailed description of the preferred embodiments of the invention is intended to be exemplary, rather than limiting, and numerous variations and modifications will be apparent to those skilled in the art upon consideration of the foregoing disclosure.

We claim:

1. In a method of producing premium delayed petroleum coke wherein a premium hydrocarbon petroleum coking feedstock having a sulfur content high enough to produce a puffing coke is heated in a coking furnace and then charged to a coking drum maintained at premium coking conditions to produce premium coke, the improvement wherein an effective amount of a puffing inhibitor consisting essentially of a hydrocarbon-soluble iron compound is added to and dissolved in said feedstock in an amount to provide an iron level of from 0.05 to 0.5 percent by weight in the coker feedstock prior to charging said feedstock to the coking drum.

2. In a method of producing premium delayed petroleum coke wherein a premium hydrocarbon petroleum coking feedstock having a sulfur content high enough to produce a puffing coke is heated in a coking furnace and then charged to a coking drum maintained at premium coking conditions to produce premium coke, the improvement wherein an effective amount of a puffing inhibitor consisting essentially of a hydrocarbon-soluble acetyl acetonate of a metal selected from the group consisting of iron, calcium, aluminum and manganese is added to and dissolved in said feedstock prior to charging said feedstock to the coking drum.

3. The method of claim 2 wherein said puffing inhibitor is ferrous acetyl acetonate and is added in an amount to provide an iron level of from 0.05 to 0.5 percent by weight in the coker feedstock.

* * * * *